US005719109A

United States Patent [19]

Tokashiki et al.

[11] Patent Number: 5,719,109

[45] Date of Patent: Feb. 17, 1998

[54] LUBRICATING OIL COMPOSITION

[75] Inventors: Michide Tokashiki; Hirotaka Tomizawa; Michiya Yamada, all of Saitama-ken, Japan

[73] Assignee: Exxon Chemical Patents Inc, Linden, N.J.

[21] Appl. No.: 666,465

[22] PCT Filed: Dec. 28, 1994

[86] PCT No.: PCT/JP94/02291

§ 371 Date: Nov. 12, 1996

§ 102(e) Date: Nov. 12, 1996

[87] PCT Pub. No.: WO95/18200

PCT Pub. Date: Jul. 6, 1995

[30] Foreign Application Priority Data

Dec. 30, 1993 [JP] Japan ..... 5-354603

[51] Int. Cl.[6] ..... C10M 137/00

[52] U.S. Cl. ..... 508/364; 508/371

[58] Field of Search ..... 508/364, 371, 508/368, 379, 420, 551

[56] References Cited

U.S. PATENT DOCUMENTS 2,977,382 3/1961 Millikan ..... 544/186

3,002,014 9/1961 Dinsmore et al. ..... 558/106

3,813,336 5/1974 Goldschmidt ..... 508/420

4,743,389 5/1988 Braid et al. ..... 508/551

FOREIGN PATENT DOCUMENTS 59207992 4/1985 Japan .

*Primary Examiner*—Prince Willis, Jr.

*Assistant Examiner*—Cephia D. Toomer

[57] ABSTRACT

The present invention provides a lubricating oil composition excellent in wear-resistant properties and frictional characteristics. The present invention relates to a lubricating oil composition containing a lubricating base oil (A) a complex obtained by reacting a metallic salt of dithiophosphoric acid having lipophilic groups, the average number of the carbon atoms of which is 4 or more, with a primary alkylamine having 8 or less carbon atoms, and (B) at least one kind of compound selected from the group consisting of oxymolybdenum sulfide dithiocarbamate, oxymolybdenum sulfide organophosphorodithioate, fatty esters, and organic amides.

12 Claims, No Drawings

LUBRICATING OIL COMPOSITION

FIELD OF THE INVENTION

The present invention relates to a lubricating oil composition, and more specifically, one excellent in wear-resistant properties and frictional characteristics. The lubricating oil composition of the present invention can be used as a lubricating oil for automotive internal combustion engines (engine oil), and also in a wide range of fields as gear oils, automatic transmission fluids (ATF), power-steering oils (PS oil), spindle oils, hydraulic fluids, and industrial lubricating oils.

BACKGROUND OF THE INVENTION

Since zinc dithiophosphates (below called "Zn-DTP") such as zinc dialkyldithiophosphates show an excellent wear-inhibiting performance, besides acting as an antioxidant and a corrosion inhibitor, they have been generally used as an additive for engine oils.

However, since phosphorus (P) contained in Zn-DTP poisons any automotive exhaust emission purification catalyst and any automotive oxygen sensor, an engine oil to which Zn-DTP is added has had a problem in that the performance of any exhaust-gas emission control system decreases significantly. Conventionally to resolve this problem a method of decreasing the added amount of Zn-DTP to lower the amount of phosphorus in the engine oil has been adopted. However, when the amount of Zn-DTP decreases, problems are caused such that the wear-resistant properties of the lubricating oil decrease and in that the engine durability decreases due to the wear of the valve-gear system. Thus while decreasing the added amount of Zn-DTP, other additives, such as an ash-free detergent dispersant and a metal detergent have been used with Zn-DTP to maintain performances necessary for an engine oil.

However, when both Zn-DTP and an ash-free detergent dispersant such as a polyalkenyl succinimide are used, a problem arises such that both compounds are the first to react in a base oil to result in the effects of Zn-DTP being masked and its activity being impaired. Accordingly, to attain sufficient wear-resistant properties, Zn-DTP must be used in a relatively high amount, and thus it has been difficult to decrease the phosphorus content.

SUMMARY OF THE INVENTION

1. Disclosure of the Invention

The object of the present invention resides in providing a lubricating oil composition excellent in wear-resistant properties and frictional characteristics.

2. Means to Resolve the Problems

As a result of the extensive study by the inventors of the present invention to resolve the above problems, they found that besides the wear-resistant properties of a lubricating oil being improved, the coefficient of friction of the oil significantly decreased by (1) adding to a lubricating base oil a complex of a metallic salt of dithiophosphoric acid (below called "M-DTP") with a primary alkylamine having a short chain and (2) containing in a lubricating base oil at least one kind of compound selected from the group consisting of an oxymolybdenum sulfide dithiocarbamate (below called "Mo-DTC"), an oxymolybdenum sulfide organophosphorodithioate (below called "Mo-DTP"), a fatty ester, and an organic amide compound.

Based on this finding they accomplished the present invention.

Thus according to the present invention a lubricating oil composition is provided by containing in a lubricating base oil (A) a complex obtained by reacting a metallic salt of dithiophosphoric acid having lipophilic groups, the average number of the carbon atoms of which is 4 or more, with a primary alkylamine having 8 or less carbon atoms, and (B) at least one kind of compound selected from the group consisting of an oxymolybdenum sulfide dithiocarbamate, an oxymolybdenum sulfide organophosphorodithioate, a fatty ester, and an organic amide.

DETAILED DESCRIPTION OF EMBODIMENT

The present invention will be described in detail below.

(Lubricating Base Oil)

Lubricating base oils used in the present invention are not specifically limited, and various kinds of conventionally-known mineral oils and synthetic lubricating oils can be used. Exemplified as the mineral oils are raffinates obtained by solvent-refining a lubricating oil material with an aromatic extraction solvent such as phenol or furfural, a hydrogenation-treated oil obtained by hydrogenation treatment with a catalyst for hydrogenation treatment such as cobalt or molybdenum supported on silica-alumina as a carrier, and a mineral oil such as a lubricating oil distillate obtained by the isomerization of wax, as, for example, 60 Neutral Oil, 100 Neutral Oil, 150 Neutral Oil, 300 Neutral Oil, 500 Neutral Oil, Bright Stock, etc. As the synthetic lubricating oils, poly-α-olefins, polybutene, alkylbenzenes, polyol esters, and dibasic acid esters, are exemplified. Such a base oil can be used alone or as a mixture of two or more kinds. When such a lubricating base oil is used in an engine oil, its kinetic viscosity is ordinarily 3 to 20 cSt at 100° C.

(Metallic Salts of Dithiophosphoric Acid)

The metallic salts of dithiophosphoric acid (M-DTP) used in the present invention are compounds represented by following general formula (I):

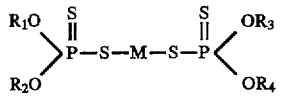

(I)

wherein M is a metal atom selected from zinc, copper, nickel, iron, cadmium, silver, lead, antimony,/in, and bismuth, and each of $R_1$ to $R_4$ is independently selected from lipophilic groups having 1 to 30 carbon atoms provided that the average number of the carbon atoms of the four lipophilic groups is 4 or more.

Each of these M-DTPs may be used alone, or two or more kinds of the M-DTPs may be used together.

As the lipophilic group, saturated and unsaturated alkyl groups, alkylaryl groups, and arylalkyl groups, are exemplified. The four lipophilic groups can be varied from those in which four of the lipophilic groups are all the same to those in which each of them is different. When the average number of the carbon atoms of the four lipophilic groups of this M-DTP is less than 4, even if the M-DTP is used with a primary alkylamine, it is difficult to obtain a uniform lubricating oil composition, since the solubility of M-DTP in a lubricating oil is poor. Since an organic metal-based wear-resistant agent generally fulfills its function by being adsorbed on the surface of metals, it is necessary to have an appropriate solubility in the oil.

In contrast, when an M-DTP is used in which the average number of the carbon atoms of the four lipophilic groups exceeds 13, although the solubility of the M-DTP in a lubricating oil is good, the wear-resistant properties decrease. From the aspect of the functionality of wear-resistant properties etc., the upper limit of the average number is preferably 13.

From the aspect of the functionalities such as the ease of their synthesis and wear-resistant properties, usually M-DTPs in which four lipophilic groups are alkyl groups having 4 or more carbon atoms are especially preferred.

As the metal atoms (M), zinc, copper, nickel, iron, cadmium, silver, lead, antimony, tin, and bismuth, are exemplified. Among others, from the aspect of functionalities such as the ready availability and wear-resistant properties, zinc (Zn) is especially preferred.

(Primary Alkylamine)

As the primary alkylamines used in the present invention, relatively short-chain alkylamines such as n-propylamine, n-butylamine, n-pentylamine, n-hexylamine, n-heptylamine, and n-octylamine, are exemplified.

When preparing a complex with an alkylamine, the amount used of M-DTP is adjusted such that the compounding ratio in a lubricating oil composition based on the total amount of the composition becomes usually 0.05 to 7% by weight, preferably 0.2 to 5% by weight, more preferably 0.3 to 2% by weight. If the compounding ratio of the M-DTP is too low, the effect in imparting wear-resistant properties is insufficient, and if the ratio is too high the wear-resistant properties do not increase above a certain degree and corrosion of metals can be caused.

The compounding ratio of the primary alkylamine is 0.001 to 0.5% by weight, preferably 0.01 to 0.3% by weight. If the compounding ratio of the primary alkylamine compound is too low, the effect obtained by the compound is insufficient, and if the ratio is too high the wear-resistant properties often decrease rather than increase.

It is preferable to first form a complex of M-DTP with a primary alkylamine, and then to add the complex to a lubricating oil, since the preferential reaction of M-DTP with an ash-free detergent dispersant is depressed, and thus a lubricating oil composition having excellent wear-resistant properties can be obtained. To first form a complex of M-DTP with a primary alkylamine, a preferable process is to add them to a lubricating base oil such that the concentration of the complex is high, and then to heat the obtained composition. For example, M-DTP is added and mixed with a primary alkylamine in a given ratio, and, if desired, the obtained mixture is diluted with the base oil to an amount equaling several times the amount of the mixture, and the obtained mixture is stirred, preferably at 40° to 120° C., more preferably at 60° to 100° C., preferably for 1 to 60 minutes, more preferably for 5 to 30 minutes, to form a complex. The higher the heating temperature is, the shorter is the time required to form a complex which is uniformly solubilized in a base oil. The resulting solution of the complex is used as a lubricating oil composition as such, or it is further diluted with a lubricating oil and used as a uniform lubricating oil composition containing M-DTP and a primary alkylamine in a desired ratio.

(Additives Used Together)

In the present invention, to a lubricating base oil, together with a complex of a metallic salt of dithiophosphoric acid and a oxymolybdenum sulfide organophosphorodithioates, fatty esters, and primary alkylamine, is added at least one kind of compound selected from the group consisting of oxymolybdenum sulfide dithiocarbamates, organic amide compounds.

Mo-DTC and Mo-DTP

The oxymolybdenum sulfide dithiocarbamates (Mo-DTC) and oxymolybdenm sulfide organophosphorodithioates (Mo-DTP) are organic molybdenum compounds represented by following general formulas (II) and (III) respectively:

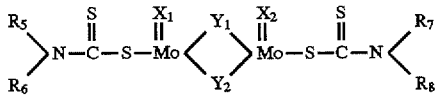

(II)

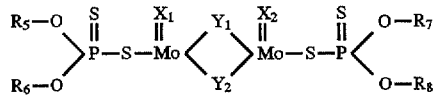

(III)

in which formulas (II) and (III) $R_5$ to $R_8$, which may be the same or different, are each a hydrogen atom, an alkyl group having 1 to 20 carbon atoms, a cycloalkyl group having 6 to 26 carbon atoms, an aryl, alkylaryl, or arylalkyl group having 6 to 26 carbon atoms, or a hydrocarbon group containing an ester bond, ether bond, alcohol group, or carboxyl group. $X_1$ and $X_2$, which may be the same or different, are each an oxygen atom or a sulfur atom. $Y_1$ and $Y_2$, which may be the same or different, are each an oxygen atom or a sulfur atom.

In general formulas (II) and (III) $R_5$ to $R_8$ are each preferably a saturated or unsaturated alkyl group having 6 to 18 carbon atoms, a cycloalkyl group having 12 to 24 carbon atoms, or an alkylaryl group having 12 to 24 carbon atoms. As the preferred examples of these substituents are alkyl groups or unsaturated alkyl groups (alkenyl groups) having 6 to 18 carbon atoms such as n-hexyl, 2-ethylhexyl, n-octyl, nonyl, decyl, lauryl, tridecyl, oleyl, and linoleyl, and alkylaryl groups substituted by an alkyl group having 3 to 18 carbon atoms, such as nonylphenyl.

Not only when Mo-DTC or Mo-DTP is used alone, but also when they are used together, is the compounding ratio of Mo-DTC and/or Mo-DTP based on the total composition of 0.01 to 10% by weight, preferably 0.05 to 5% by weight, more preferably 0.1 to 1% by weight. If the compounding ratio is less than 0.01% by weight, the wear-decreasing effect of the composition is low, and if it is too high, a problem such as the occurence of copper-corrosive properties tends to appear. To aim to lower the phosphorus content in a lubricating oil, as the organic molybdenum compound, it is preferred to use Mo-DTC alone, or when Mo-DTP is used it is used such that its compounding ratio is as low as 0.2% by weight or less. By using a combination of specified additives, even if the ratio used of the organic molybdenum compound is relatively low, an excellent effect in regards to the coefficient of friction can be obtained.

Fatty Ester

As the fatty esters used in the present invention, monoesters and diesters of a fatty acid and glycerine or sorbitan are exemplified.

The fatty glyceride is a monoester represented by following general formula (IV) or a diester represented by following general formula (V):

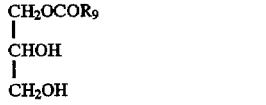

(IV)

-continued $$\begin{array}{l} CH_2OCOR_{10} \\ | \\ CH_2OCOR_{11} \\ | \\ CH_2OH \end{array} \quad (V)$$

in which formulas (IV) and (V) $R_9$ to $R_{11}$ are each a saturated or unsaturated alkyl group having 8 to 22 carbon atoms.

The fatty ester may be used alone or as a mixture of two or more kinds of the esters. Based on the total composition its compounding ratio is 0.01 to 10% by weight, preferably 0.05 to 5% by weight. If the compounding ratio is too low any improved effect in the frictional characteristics is too low, and if it is too high the wear-resistant properties worsen.

Organic Amide Compound

An organic amide compound used in the present invention is a compound represented by following general formula (VI):

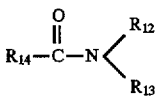

(VI)

in which formula (VI) $R_{12}$ and $R_{13}$, which may be the same or different, are each a hydrogen atom, an alkyl group having 1 to 20 carbon atoms, a cycloalkyl group having 6 to 26 carbon atoms, or an aryl, alkylaryl, or arylalkyl group having 6 to 26 carbon atoms, an alkylene oxide group having 2 to 30 carbon atoms, and $R_{14}$ is a hydrogen atom, an alkyl group having 1 to 20 carbon atoms, an cycloalkyl group having 6 to 26 carbon atoms, an aryl, alkylaryl, or arylalkyl group having 6 to 26 carbon atoms, or a hydrocarbon group having an ester bond, an ether bond, or a carboxyl group.

The alkylene oxide group used here is a group represented by following general formula (VII) or (VIII):

$$\left(CH_2\underset{\underset{R'}{|}}{C}HO\right)_n H \quad (VII)$$

$$\left(\underset{\underset{R'}{|}}{C}HCH_2O\right)_n H \quad (VIII)$$

in which formulas (VII) and (VIII) R' is a hydrogen atom or a methyl group, and n is an integer of 1 to 10.

In general formula (VI) $R_{12}$ and $R_{13}$ are preferably each a hydrogen atom, an alkyl group having 2 to 8 carbon atoms, a cycloalkyl group having 8 to 14 carbon atoms, an alkylaryl group having 8 to 14 carbon atoms, or an alkylene oxide in which n is 1 to 5, and $R_{14}$ is preferably a saturated or unsaturated alkyl group having 6 to 18 carbon atoms, a cycloalkyl group having 12 to 24 carbon atoms, or an alkylaryl group having 12 to 24 carbon atoms.

As such organic amides, oleic amide and lauric amide are exemplified.

The compounding ratio of the organic amide compound is 0.01 to 10% by weight, preferably 0.01 to 5% by weight, more preferably 0.05 to 2% by weight. By adding the organic amide compound, while copper-corrosive properties are lowered, the coefficient of friction can be decreased from the beginning. If the compounding ratio is too small, the effect in decreasing friction is low, and if too high the effect does not increase above a certain degree.

(Lubricating Oil Composition)

The lubricating oil composition of the present invention can be prepared by adding said various ingredients to a lubricating base oil. M-DTP and a primary alkyl amine are first reacted to form a complex, and then the complex is added to the lubricating oil.

To a lubricating oil composition of the present invention, if required, a wear-resistant agent, a friction-decreasing agent, an ash-free detergent dispersant, an anti-oxidant, a metal detergent, a viscosity index-improving agent, a pour-point lowering agent, a rust-preventive agent, a defoaming agent, a corrosion-preventive agent, etc., may be suitably added.

As wear-resistant agents, zinc salt of dithiocarbamic acid, phosphoric esters, and amine salts of phosphoric esters, are exemplified.

As ash-free detergent dispersants, polyalkenyl succinic imides, polyalkenyl succinic amides, alkylbenzyl amines, boron derivatives of polyalkenyl succinic imides, and boron derivatives of alkylbenzyl amines, are exemplified.

As the anti-oxidant agents, amine-based anti-oxidant agents such as alkylated diphenylamines, phenyl-α-naphtylamine, and alkylated α-naphtylamine, and phenol-based anti-oxidant agents such as 2,6-di-t-butylphenol and 4,4'-methylene-bis-(2,6-di-t-butylphenol), are exemplified. The agent is usually used in a ratio of 0.05 to 2% by weight.

Exemplified as the metal detergents are Ca-sulfonate, Mg-sulfonate, Ba-sulfonate, Ca-phenate, Ba-phenate, Mg-phenate, Ca-salicylate, Mg-salicylate, and Ba-salicylate. They are usually used in a ratio of 0.1–5% by weight.

Exemplified as the viscosity-index improving agents are polymethylmethacrylate-type, polyisobutyrene-type, ethylene-propylene-copolymer-type, and hydrogenated styrene-butadiene copolymer-type agents. They are usually used in a ratio of 1–35% by weight.

Exemplified as the rust-preventive agents are alkenyl succinic acids and partially esterified alkenyl succinic acids.

As the defoaming agents, dimethyl polysiloxane and polyacrylate are exemplified.

By adopting the above constitution the lubricating oil compositions of the present invention can significantly decrease the coefficient of friction, besides showing superior wear-resistant properties. Also, by using zinc dithiocarbamate (Zn-DTC) with M-DTP, the ratio of M-DTP can be significantly decreased, to obtain a lubricating oil composition with a lower content of phosphorus than those conventionally used.

Because of the use of a combined system of M-DTP and a primary alkylamine, the lubricating oil compositions of the present invention have properties, such as oxidation stability and anti-coking properties, besides wear-resistant and extreme-pressure properties.

Although the reason why the lubricating oil compositions of the present invention show excellent wear-resistant properties is unclear, it is considered that due to the formation of a complex of M-DTP and a primary alkylamine, the reaction of M-DTP with an ash-free detergent dispersant is depressed, thus making the adsorption of M-DTP on the surface of metals easy.

The lubricating oil compositions are used for automotive engine oils, gear oils, automatic transmission fluids, power-steering oils, spindle oils, hydraulic fluids, and industrial lubricating oils.

The present invention is especially illustrated by the following Examples and Comparative Examples, but it is not limited to those Examples.

EXAMPLES 1 TO 8, AND COMPARATIVE EXAMPLES 1 TO 4

Lubricating oil compositions were prepared by adding the various ingredients listed in Table 1. In the Table the ratios of the various ingredients are represented by % by weight. The remaining portion is the ratio of a lubricating base oil. Zn-DTP, in which the number of carbon atoms of a lipophilic group is 6, is first reacted with n-hexylamine to form a complex, and then the complex is used.

Various ingredients are shown below.

(1) Lubricating base oil

150 Neutral mineral oil (The kinetic viscosity at 100° C. is 5.1 cSt.)

(2) Zn-DTP

A commercially available Zn-DTP: a Zn-DTP having four s-hexyl groups.

After the Zn-DTP is reacted with n-hexylamine in a mineral oil to form a complex, the complex was further diluted with a mineral oil.

(3) Mo-DTC

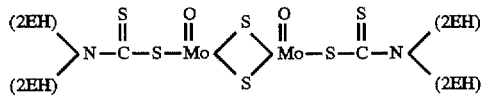

wherein 2EH is a 2-ethylhexyl group.

(4) Mo-DTP

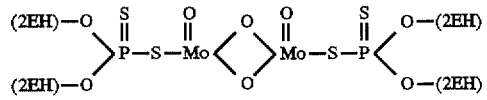

wherein 2EH is a 2-ethylhexyl group.

(5) Fatty glyceride

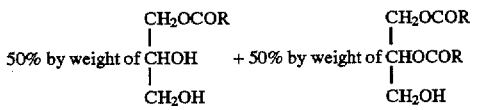

wherein R is an oleyl group.

(6) Organic amide compound

Oleic amide

Treatment for Forming a Complex

Zn-DPT in which the number of carbon atoms of a lipophilic group is 6, n-hexylamine, and a mineral oil, were mixed in a weight ratio of 1:0.28:1 in a reactor equipped with a stirrer, and the obtained mixture was heated at 60° C. for 5 minutes with stirring. The resulting solution containing the formed complex was further diluted with a mineral oil to be prepared such that the content of Zn-DTP was 0.5% by weight or 1.0% by weight.

For the obtained lubricating oil compositions, the wear-resistant properties and coefficients of friction were evaluated. The results are listed in Table 1. The method of measuring was as shown below.

Method of Measuring Frictional Characteristics and Wear-resistant Properties

By using the Shell four-ball-type test, the coefficients of friction and ball diameters after wear (mm) were measured. The conditions were as follows:

Load: 40 kg

Oil temperature: 90° C.

Number of revolutions: 1,800 rpm

Test time: 30 minutes

TABLE 1

| | Examples | | | | | | | | Comparative Examples | | | |
|---|---|---|---|---|---|---|---|---|---|---|---|---|
| | 1 | 2 | 3 | 4 | 5 | 6 | 7 | 8 | 1 | 2 | 3 | 4 |
| Commercially Available Zn—DTP(s-$C_6$) | 0.5 | 1.0 | 0.5 | 0.5 | 0.5 | 0.5 | 0.5 | 0.5 | 0.5 | 1.0 | 0.5 | 1.0 |
| n-hexylamine | 0.14 | 0.28 | 0.14 | 0.14 | 0.14 | 0.14 | 0.14 | 0.14 | 0.14 | 0.28 | — | — |
| Mo—DTC | 0.15 | 0.15 | 1.5 | 0.15 | 0.5 | — | 0.15 | 0.15 | — | — | — | — |
| Mo—DTP | — | — | — | — | — | 0.15 | — | 0.075 | — | — | — | — |
| Fatty Glyceride | 0.075 | 0.075 | 0.075 | 1.5 | — | 0.075 | 0.075 | — | — | — | — | — |
| Oleic Amide | — | — | — | — | 0.3 | — | 0.3 | 0.3 | — | — | — | — |
| Coefficient of Friction | 0.053 | 0.056 | 0.052 | 0.053 | 0.052 | 0.057 | 0.051 | 0.053 | 0.083 | 0.090 | 0.120 | 0.125 |
| Ball Diameter After Wear (mm) | 0.43 | 0.41 | 0.43 | 0.45 | 0.44 | 0.45 | 0.44 | 0.45 | 0.042 | 0.39 | 0.49 | 0.43 |

As is clear from the results as listed in Table 1, any lubricating oil composition of the present invention shows, besides a significantly low coefficient of friction and good low-friction properties, that the ball diameter after wear is small and that the wear-resistant properties are good. In contrast, when only the combination system of Zn-DTP and n-hexylamine is used (Comparative Examples 1 and 2), the effect in decreasing the coefficient of friction was insufficient. When n-hexylamine was not used (Comparative Examples 3 and 4) the coefficient of friction was further increased, and the frictional characteristics were insufficient.

According to the present invention, lubricating oil compositions excellent in wear-resistant properties and frictional characteristics are provided. Although any lubricating oil composition of the present invention has a low phosphorus content, it shows excellent wear-resistant properties and a low coefficient of friction, and thus it is especially suitable for internal combustion engines.

We claim:

1. A lubricating oil composition comprising a major portion of a lubricating base oil and as additives:

(A) a complex obtained by reacting (1) a metallic salt of dithiophosphoric acid having lipophilic groups, the average number of carbon atoms in each of the lipophilic groups is between 4 and 13 carbon atoms with (2) a primary alkylamine having 8 or less carbon atoms, and (B) at least one compound selected from the group consisting of oxymolybdenum sulfide dithiocarbamate, oxymolybdenum organophosphorodithioate, fatty esters, and organic amides, with the additives being present in a minor amount to provide wear resistant properties and a decreased coefficient of friction to the composition.

2. A lubricating oil composition according to claim 1 wherein said complex is present in said composition in an amount to provide from about 0.2 to about 5% by weight of said metallic salt of dithiophosphoric acid and from about 0.01 to about 0.3% by weight of said primary alkylamine, and the at least one compound component (B) is present in said composition in an amount of from about 0.01 to about 5% by weight.

3. A lubricating oil composition according to claim 2 wherein said metallic salt of dithiophosphoric acid is a zinc salt and said primary alkylamine is N-hexylamine.

4. A lubricating oil composition according to claim 3 wherein said metallic acid of dithiophosphoric acid is zinc O,O-dihexyl dithiophosphate.

5. A lubricating oil composition according to claim 4 wherein the at least one compound of component (B) comprises an oxymolybdenum sulfide dithiocarbamate.

6. A lubricating oil composition according to claim 4 wherein the at least one compound of component (B) comprises an oxymolybdenum organophosphorodithioate.

7. A lubricating oil composition according to claim 5 wherein the at least one compound of component (B) additionally comprises an oxymolybdenum organophosphorodithioate.

8. A lubricating oil composition according to claim 5 wherein the at least one compound of component (B) additionally comprises a fatty glyceride that comprises 50% by weight of an oleyl monoester of glycerine and 50% by weight of an oleyl diester of glycerine.

9. A lubricating oil composition according to claim 6 wherein the at least one compound of component (B) additionally comprises a fatty glyceride that comprises 50% by weight of an oleyl monoester of glycerine and 50% by weight of an oleyl diester of glycerine.

10. A lubricating oil composition according to claim 5 wherein the at least one compound of component (B) additionally comprises oleic amide.

11. A lubricating oil composition according to claim 7 wherein the at least one compound of component (B) additionally comprises oleic amide.

12. A lubricating oil composition according to claim 8 wherein the at least one compound of component (B) additionally comprises oleic amide.

* * * * *